US005501382A

United States Patent [19]

Webb

[11] Patent Number: 5,501,382

[45] Date of Patent: Mar. 26, 1996

[54] UNIVERSAL HAND TOOL HOLDER

[76] Inventor: Edward H. Webb, 17003 County Rd. 181, Paynesville, Minn. 56362

[21] Appl. No.: 389,208

[22] Filed: Feb. 15, 1995

Related U.S. Application Data

[63] Continuation-in-part of Ser. No. 191,776, Feb. 2, 1994, abandoned.

[51] Int. Cl.[6] ..... A45F 5/00

[52] U.S. Cl. ..... 224/253; 224/242; 224/904; 206/372

[58] Field of Search ..... 224/149, 200, 224/224–226, 242, 243, 249, 251–253, 268, 269, 904, 151; 206/372–378; 312/902

[56] References Cited

U.S. PATENT DOCUMENTS

| | | | |
|---|---|---|---|
| 1,150,776 | 8/1915 | Lamb | 224/253 X |
| 1,806,477 | 5/1931 | Lloyd et al. | 224/253 X |
| 1,815,101 | 7/1931 | Goldstein | 224/253 X |
| 2,576,231 | 11/1951 | Lawson, Jr. et al. | 224/912 |
| 3,168,972 | 2/1965 | Parlante et al. | 224/911 |
| 3,227,337 | 1/1966 | Santo, Jr. | 224/911 |
| 3,294,298 | 12/1966 | Danielson | 224/904 |
| 3,516,585 | 6/1970 | Inwood | 224/904 |
| 3,884,789 | 5/1975 | Czubak | 204/224 R |
| 3,916,738 | 11/1975 | Neubrand et al. | 82/18 |
| 4,088,250 | 5/1978 | Schaefer | 224/252 X |
| 4,299,345 | 11/1981 | Lanzl | 224/252 |
| 4,544,089 | 10/1985 | Tabler | 224/192 |
| 4,620,426 | 11/1986 | Pitchford et al. | 224/252 X |
| 4,653,638 | 3/1987 | Lackner et al. | 206/373 |
| 4,821,933 | 4/1989 | Seber | 224/248 |
| 4,828,154 | 5/1989 | Clifton, Jr. | 224/253 |
| 4,852,930 | 8/1989 | Agee | 294/143 |
| 4,915,215 | 4/1990 | Brekke | 224/242 X |
| 4,917,281 | 4/1990 | Ostermiller | 224/253 |
| 4,928,823 | 5/1990 | Campbell | 206/338 |
| 4,953,764 | 9/1990 | Kovacs | 224/151 |
| 4,953,765 | 10/1990 | Little et al. | 224/151 |
| 4,966,321 | 10/1990 | Outlaw | 224/253 |
| 5,009,348 | 8/1991 | Derkatz | 224/232 |
| 5,232,136 | 8/1993 | Unger | 224/151 |
| 5,248,072 | 9/1993 | Jones | 224/253 X |

*Primary Examiner*—J. Casimer Jacyna
*Attorney, Agent, or Firm*—David George Johnson

[57] ABSTRACT

A universal tool holder (100) including a holster (110) and a rigid mounting panel (120) attached to and extending above the holster (110). The holster (110) defines an epitrochoidal cavity (1) which includes a biasing crease (2) along the rear convex wall (119). The holder (100) includes a belt mounting means (124*a*, 124*b*) and a wall mounting means (125*a*, 125*b*) which are formed as part of the panel (120). The lower opening of the holster defined by the lower edge (114) has a surface area that is at least fifty percent as great as the projected surface area defined by the upper edge (113), thereby permitting insertion of a large variety of tools (90) into the holster (110).

4 Claims, 9 Drawing Sheets

UNIVERSAL HAND TOOL HOLDER

This application is a continuation in part of application Ser. No. 08/191,776, filed on Feb. 2, 1994 and now abandoned.

1. Field of the Invention

The present invention relates to a tool holster or caddy for permitting the mounting of hand held tools on a wall or a belt, and for the transport of such tools.

2. Description of Related Technology

Many hand held tools are used at field locations and stored in a shop or vehicle after such use. In order to properly care for such tools, their storage must insure that they are separated from the debris and moisture of the ground or a floor area. Further, the tool must be held securely in the storage container in order to prevent damage to the tool, especially if the storage container is also to be utilized as the transport container for the tool when it is used in the field. Due to the wide varieties of tool shape, size and ruggedness, previous attempts to provide a universal tool holder have been unsatisfactory compromises in material choice and holder configuration. An early example of such a holder is disclosed in U.S. Pat. No. 2,576,231, issue to Lawson, Jr. et al. Lawson, Jr. et al discloses a holder for a gardening tool for scaring birds away from garden plants or as a tool which is useful in winning certain sporting games. The Lawson, Jr. et al. holder includes a curved wall of an elliptical configuration, a flat wall and slits which permit the holder to be secured to a belt. The Lawson, Jr. et al. holster includes a relatively narrow bottom opening for securing the nose of the tool. The substantial taper of the Lawson, Jr. et al. device makes it unsuitable for tools having substantially different shapes.

A narrow bottom opening and sharply tapering shape are also disclosed in the holsters of U.S. Pat. Nos. 3,168,972 and 3,227,337.

In an effort to secure tool holders to walls and belts, a variety of slits and orifices have been employed. For example, in U.S. Pat. No. 3,294,2978, issued to Danielson, a wall hanging hole is located between two longitudinal slits. A hole located above adjacent longitudinal slits is shown in U.S. Pat. No. 4,821,933, issued to Seber. The use of the single hole provided in each of these references is often inadequate when the wall to which the holster is secured is movable, such as in a vehicle.

A much larger nail holder is disclosed in U.S. Pat. No. 4,953,764, issued to Kovacs which uses a plurality of shaped holes having a narrow opening for the purpose of locking the holder onto the fastener. The Kovacs device must be closed, latched and lifted by a handle in order to be transported, and cannot be worn by the user of the device in the field. A pouch which can be secured to any surface by means of hook and loop fasteners is disclosed in U.S. Pat. No. 4,953,765, issued to Little et al. The lack of ruggedness of such fasteners prevents their use with heavy tools in a field environment.

Other specialized tool holders are known, such as the pliers holder disclosed in U.S. Pat. No. 3,516,585, issued to Inwood. While the Inwood holder has a large cross sectional area, its use is largely limited due to the placement of a peg at its mouth to prevent the pliers from sliding completely through the holder. A tiltable knife holder is disclosed in U.S. Pat. No. 5,009,348, issued to Derkatz. The Derkatz device is limited to holding long, narrow objects and is closed at its lower end, thereby restricting its use to items under a certain length.

A final example of a single purpose tool holder is disclosed in U.S. Pat. No. 5,232,136, issued to Unger. While a clip on the Unger device is open at both ends, the lower extremity of the device terminates at a shelf which prevents further downward movement of the retained tool. The Unger device is limited to use with a particular style of blade or scraper having a tubular handle of a specific diameter.

Another problem faced by designers of universal tool holders is the choice of material from which to construct the holder. In order to protect the article being held, the material should be rugged, but if the material is stiff, the shape of the article to be held has heretofore been limited. In U.S. Pat. No. 4,299,345, issued to Lanzl, a high density polypropylene material is used. Unfortunately, the resulting holder is of a very specialized shape and is useful only for storing and dispensing balls, not for storing a variety of hand tools. A similar result is achieved in the device disclosed in U.S. Pat. No. 4,653,638, issued to Lackner et al., which shows a tool holder constructed of high density polyethylene. The Lackner et al. device is restricted to the secure restraint and storage of tubular items only.

In order to provide a more elliptical shape, an adjustable holder is disclosed in U.S. Pat. No. 4,544,089, issued to Tabler. In use, however, the holder's interior cavity is defined by a foldable pad which must be reconfigured each time the holder is used. Another flexible holster is disclosed in U.S. Pat. No. 4,966,321, issued to Outlaw, which again must be reconfigured for each tool used. In an effort to provide a universal shape, the ruggedness of the holster has been sacrificed by constructing the holster of a very flexible, cloth like material. Further, even in a light duty environment, eventual wear and need for replacement of the material can be expected.

U.S. Pat. No. 4,828,154, issued to Clifton, Jr., discloses a rigid plastic, somewhat elliptical holster which is open at both ends. However, the Clifton, Jr. device teaches, as do other prior art holsters, that the lower open end must be of a substantially reduced diameter in order to properly secure the tool within the holster. The Clifton, Jr. design limits the use of the holster only to those gun type hand tools having a relatively wide grip portion and a substantially narrower nose or tip. A similar holster is disclosed in U.S. Pat. No. 4,917,281, issued to Ostermiller.

Another problem with a generic tool holder is that it may be difficult to identify, at glance, the tool being retained by the holder. One solution to this problem is disclosed in U.S. Pat. No. 4,852,930, issued to Agee, in which tools are decorated to match a decorated tool holder. One problem with the Agee device is a lack of portability. Another is its failure to match an individual tool with the holder. Rather, the holder of Agee merely identifies a tool as being part of a set of tools associated with a particular holder. A colored box for nails and staples is disclosed in U.S. Pat. No. 4,928,823, issued to Campbell.

Thus, the prior art is devoid of a truly universal tool holder which can securely grip a variety of hand tools having varied shapes and dimensions. Further, the construction of such a tool holder of a material and in a manner which protects the tool while preserving the simplicity and portability of the tool holder has not been disclosed. Finally, a tool holder having these characteristics and being formed as a single, integral unit have not been taught by the prior art. Rather, previous universal tool holders have tended toward increasing complexity as greater versatility is achieved.

SUMMARY OF THE INVENTION

The present invention provides a tool holder having a holster portion that is designed to hold a hand held tool, such as a drill, and an attachment portion that is designed to secure the tool holder to a wall or to a belt worn about a person's waist. The holster portion includes an open-ended tube having a substantially epitrochoidal cross-section. The attachment portion includes a flat panel substantially coplanar with a rear wall of the holster portion. A pair of slots are formed in the flat panel to receive a belt worn about a person's waist, and a pair of upwardly narrowing openings are formed in the flat panel to receive a pair of screws partially threaded into a wall.

In operation, the present invention allows a particular tool to be kept in its appropriate tool holder whenever the tool is not in use. As a result, hand held tools can be stored in a manner that minimizes the risk of accidents, as well as time spent looking for tools. The holster portion is sized and configured to hold any of a variety of hand held tools. However, recognizing that typical workshops have numerous, different types of hand held tools, the present invention also provides a set of tool holders, each of which may have a somewhat customized holster portion to better accommodate a particular tool. Additionally, by providing each tool holder with a particular location on a certain wall, and/or a distinctive color, each tool is immediately associated with a particular location and/or a particular color. In such environments, the present invention not only keeps the tools out of harm's way, but also enables a person to more readily locate a particular tool from among many tools that might otherwise be haphazardly arranged and appear quite similar from a distance.

A preferred embodiment of the tool holder is an integral piece of molded, rigid plastic that will not scratch objects against which it comes into contact. Also, as compared to more pliable holsters made of leather or the like, the rigid holster of the present invention is easier to use because it does not collapse when the tool is removed. The tool holder is also relatively inexpensive to manufacture and durable because of its integral, one piece design. These and other advantages of the present invention will become apparent to those skilled in the art upon a more detailed description of a preferred embodiment.

BRIEF DESCRIPTION OF THE DRAWING

In the Figures, wherein like numerals represent like parts and assemblies throughout the several views.

DETAILED DESCRIPTION OF THE PREFERRED EMBODIMENTS

Figure 1:
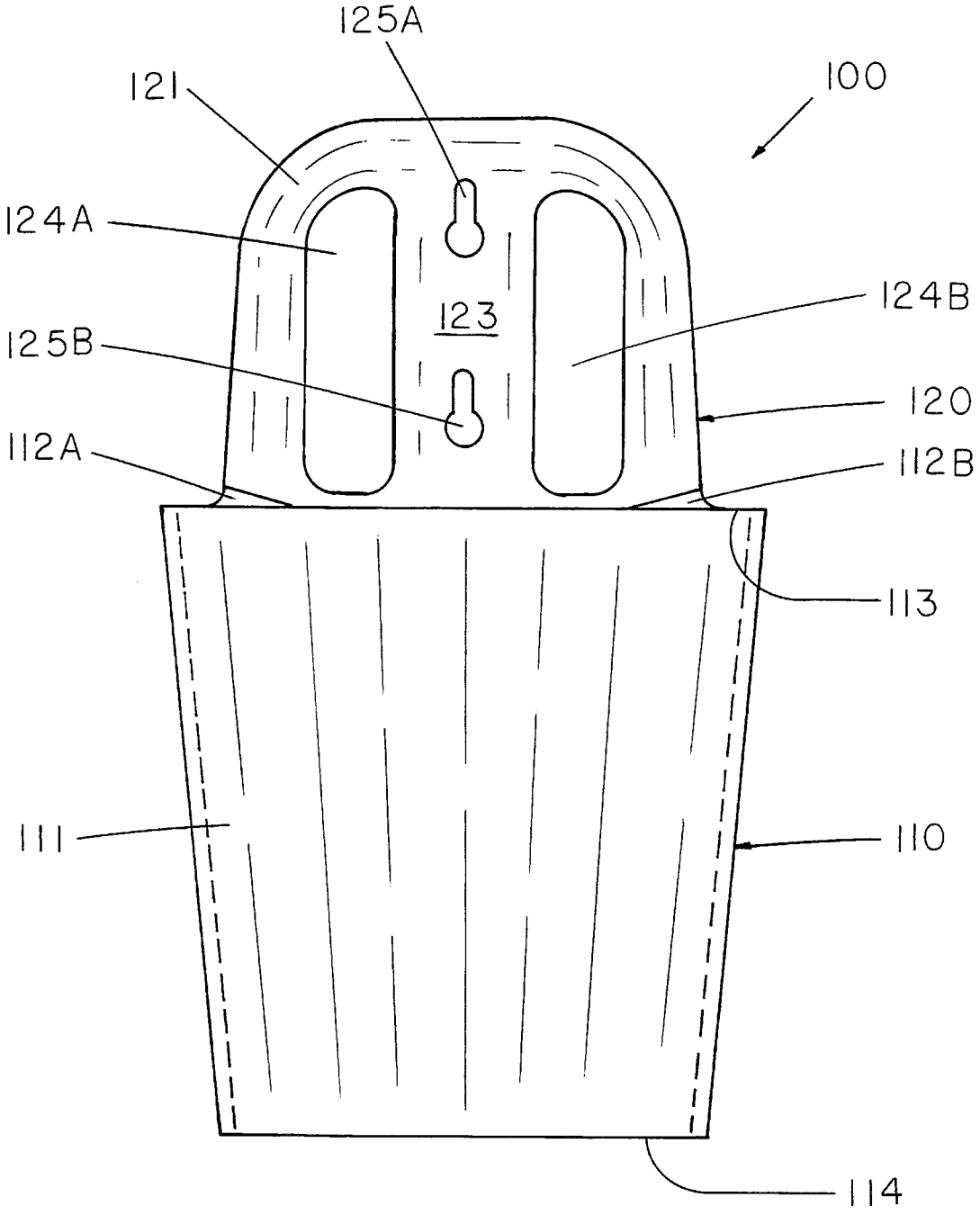
FIG. 1 is a front view of a first tool holder constructed according to the principles of the present invention.
Figure 2:
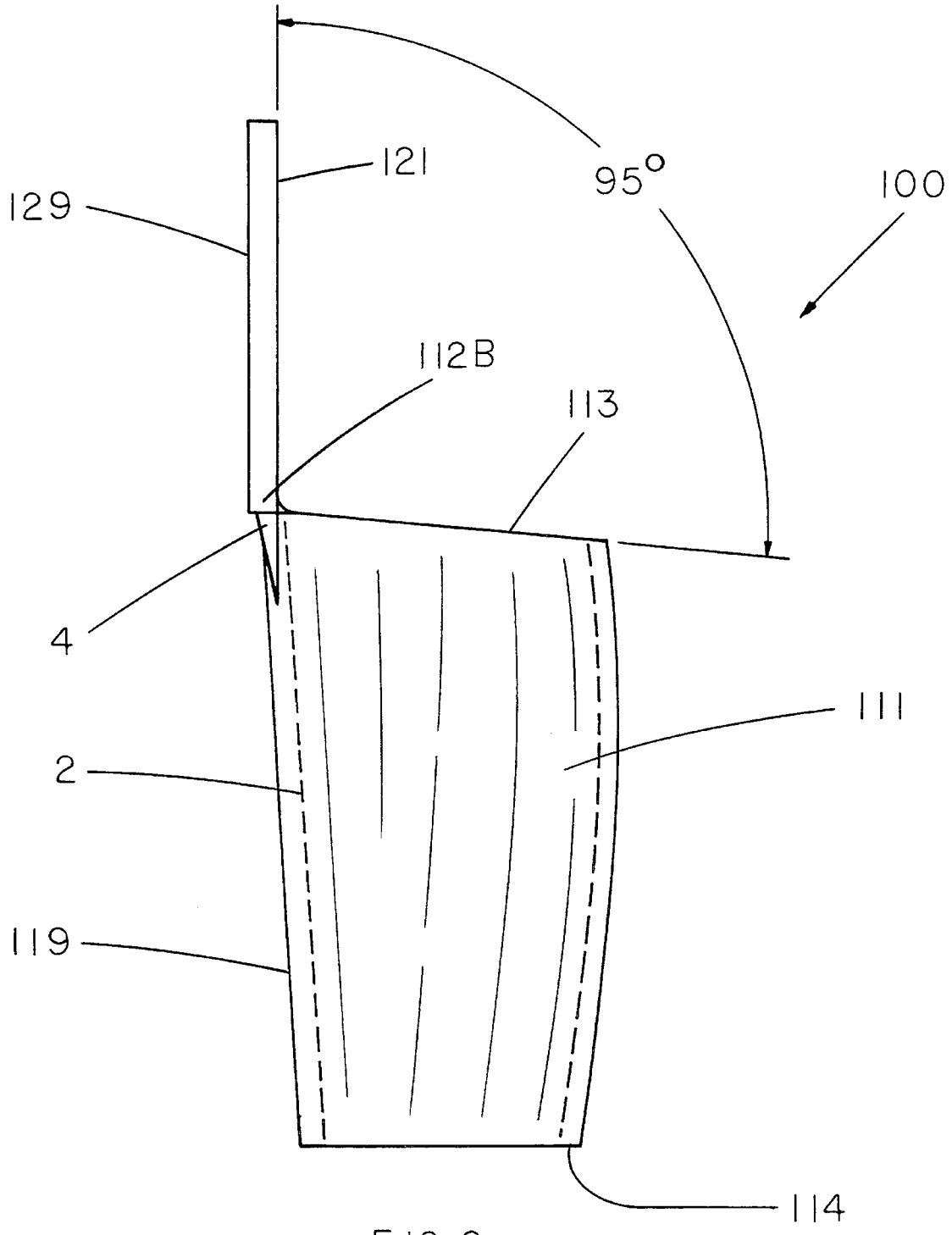
FIG. 2 is a side view of the tool holder shown in FIG. 1.
Figure 3:
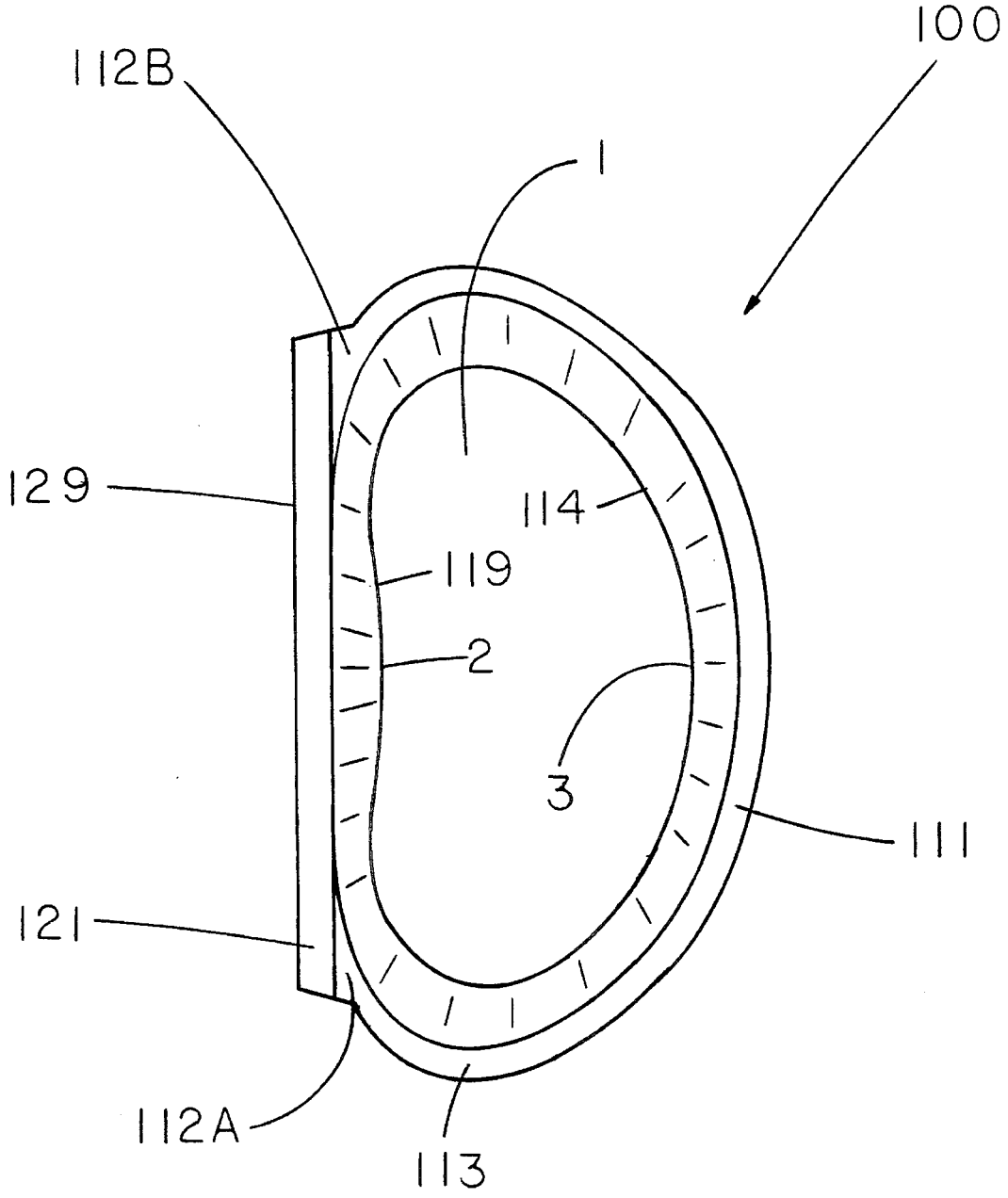
FIG. 3 is a top view of the tool holder shown in FIG. 1.
Figure 4:
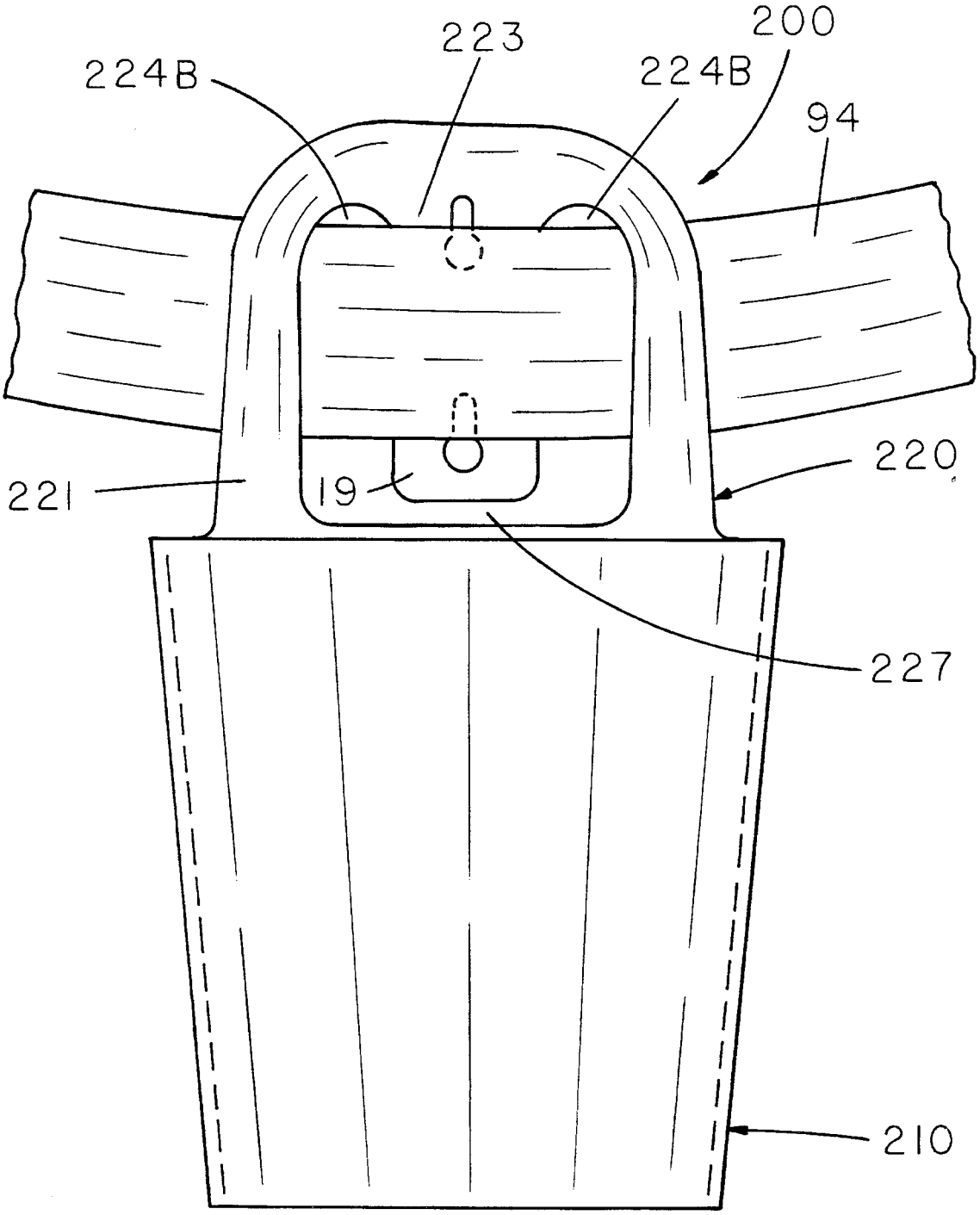
FIG. 4 is a front view of a second tool holder constructed according to the principles of the present invention and mounted on a belt worn about a person's waist.
Figure 5:
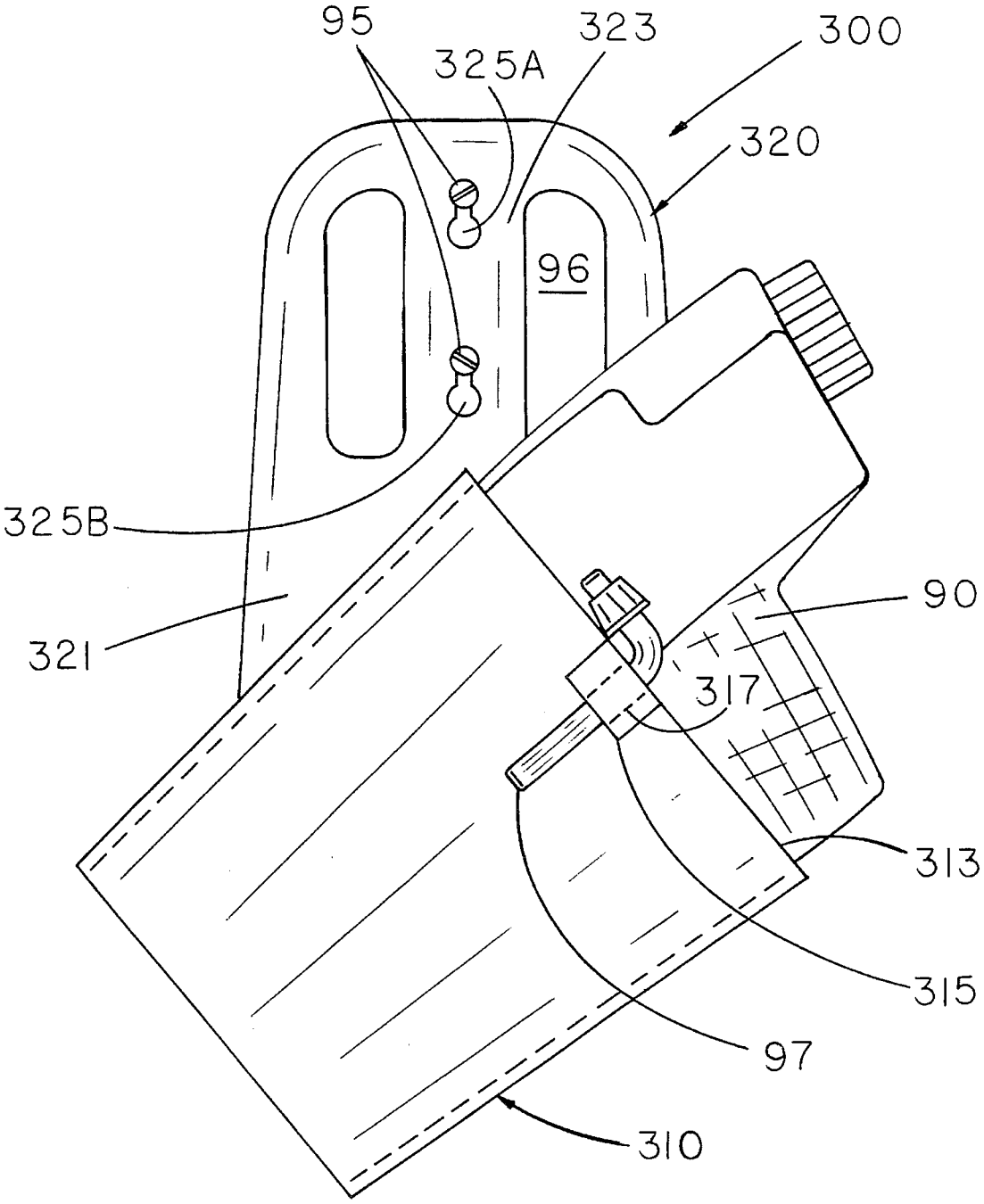
FIG. 5 is a front view of a third tool holder constructed according to the principles of the present invention and mounted on a wall.

A first tool holder constructed according to the principles of the present invention is designated as 100 in FIGS. 1–3 and 7–9. The tool holder 100 includes a first portion 110 that functions to hold a tool, such as a hand held electric drill 90 as shown in FIG. 5. The tool holder 100 also includes a second portion 120 that functions to secure the tool holder 100 to a wall 96, as seen in FIG. 5, or to a belt 94, as seen in FIG. 4, so that the tool holder 100 may be worn about a person's waist (not shown). The first portion 110 is disposed beneath the second portion 120 when the tool holder 100 is in its preferred operative position.

The lower portion 110 of the tool holder 100 includes a curved front wall 111 and a creased or indented back wall 119, both walls 111 and 119 having a substantially uniform wall thickness of approximately one eighth of an inch. As seen in FIG. 2, the front wall 111 is slightly concave, while as seen in FIG. 3, the rear wall 119 is slightly convex. As best seen in FIG. 5, an optional tab 315 extends outward from the upper edge 313 of the front wall 111, and a hole 317 is formed through the tab 315 to provide a means for supporting a hand tool accessory, such as a drill chuck key 97.

The walls 111 and 119 cooperate to define a tapering holster cavity 1 having a substantially epitrochoidal cross section that is suitably dimensioned to accommodate a variety of hand held tools. The greatest lateral dimension of the epitrochoidal cavity 1 is approximately 4.5 inches at the upper edge 113 of the holster 110 and is approximately 3.5 inches at the lower edge 114. The rear wall 119 includes a hump or crease 2 which extends longitudinally from the lower edge 114 to the upper edge 113. The distance between the crease 2 and the midpoint 3 of the front wall 111 is approximately 2.5 inches at the upper edge 113 and approximately 2.0 inches at the lower edge 114. The upper edge 113 is not parallel to the lower edge 114. Lower edge 114 is substantially perpendicular to the back wall 119, while the upper edge 113 is inclined to the back wall 119 at an angle of approximately ninety five degrees.

The upper portion 120 of the tool holder 100 includes a flat wall or panel 121 that is approximately one quarter of an inch thick. The outer surface 129 of the upper panel 121 extends approximately 0.2 inch beyond the upper edge 113 in the region of rear wall 119. The upper panel 121 is tilted at an angle of approximately five degrees with respect to the rear wall 119. The joint 4 between rear wall 119 and upper panel 121 is somewhat resilient, and the 0.2 inch overhang of rear surface 129, combined with the five degree offset between rear wall 119 and the upper panel 121 causes the rear wall 119 and the outer surface 129 to become substantially parallel when an object such as drill 90 is placed within the holster cavity 1. This arrangement is particularly advantageous in promoting stability and reducing wear of the holster 100, whether it is being worn or attached to a wall.

Figure 7:
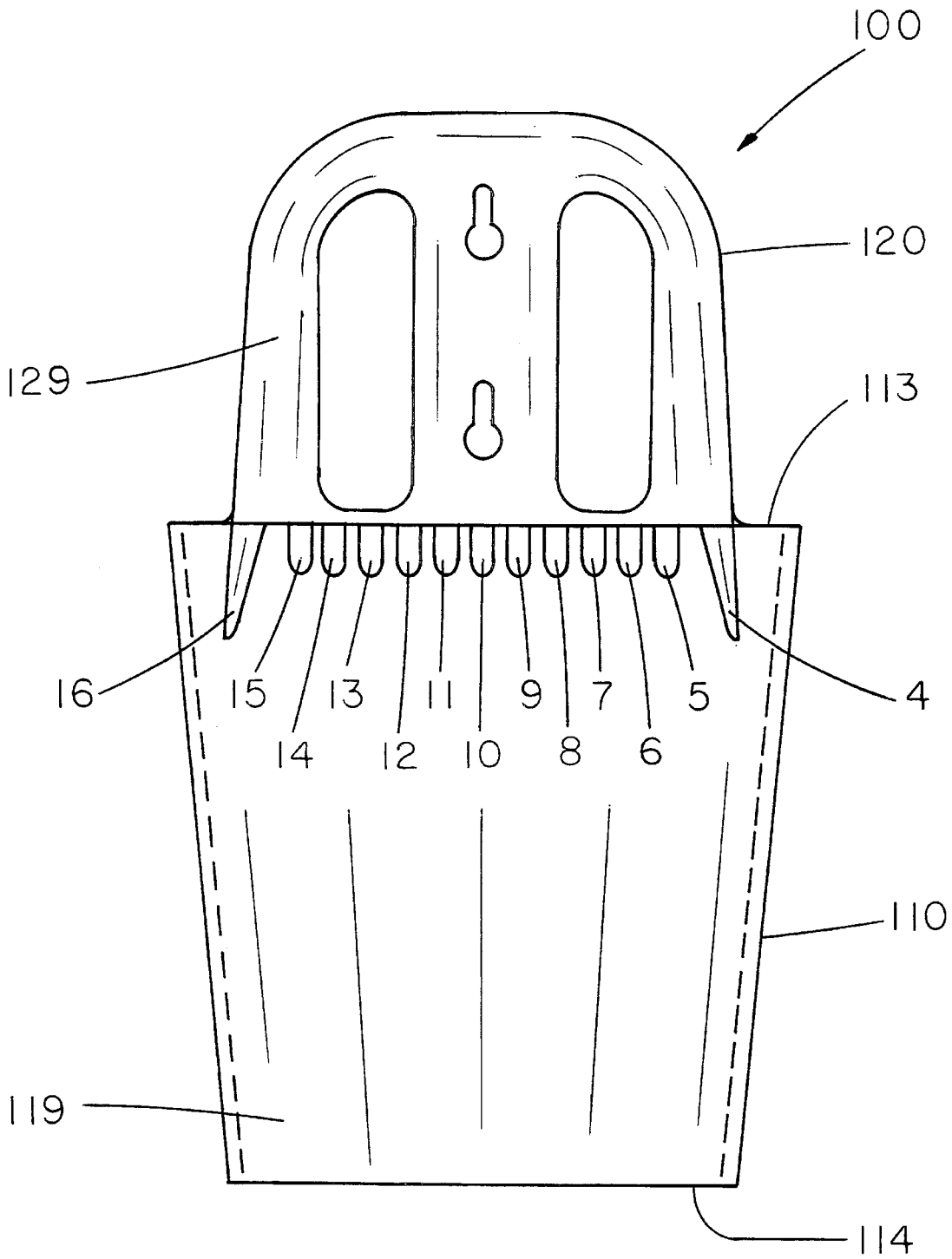
FIG. 7 is a rear view of the tool holder depicted in FIG. 3.

As best seen in FIG. 7, the upper portion 120 is integrally formed as part of rear wall 119 through a series of slightly resilient joints 4, 5, 6, 7, 8, 9, 10, 11, 12, 13, 14, 15 and 16. Further, a pair of flanges 112*a* and 112*b* (FIG. 1) also connect the upper portion 120 to the lower portion 110. The flanges 112*a* and 112*b* enhance structural integrity of the tool holder 100 and help to guide the tool 90 into the holster 110.

Figure 8:
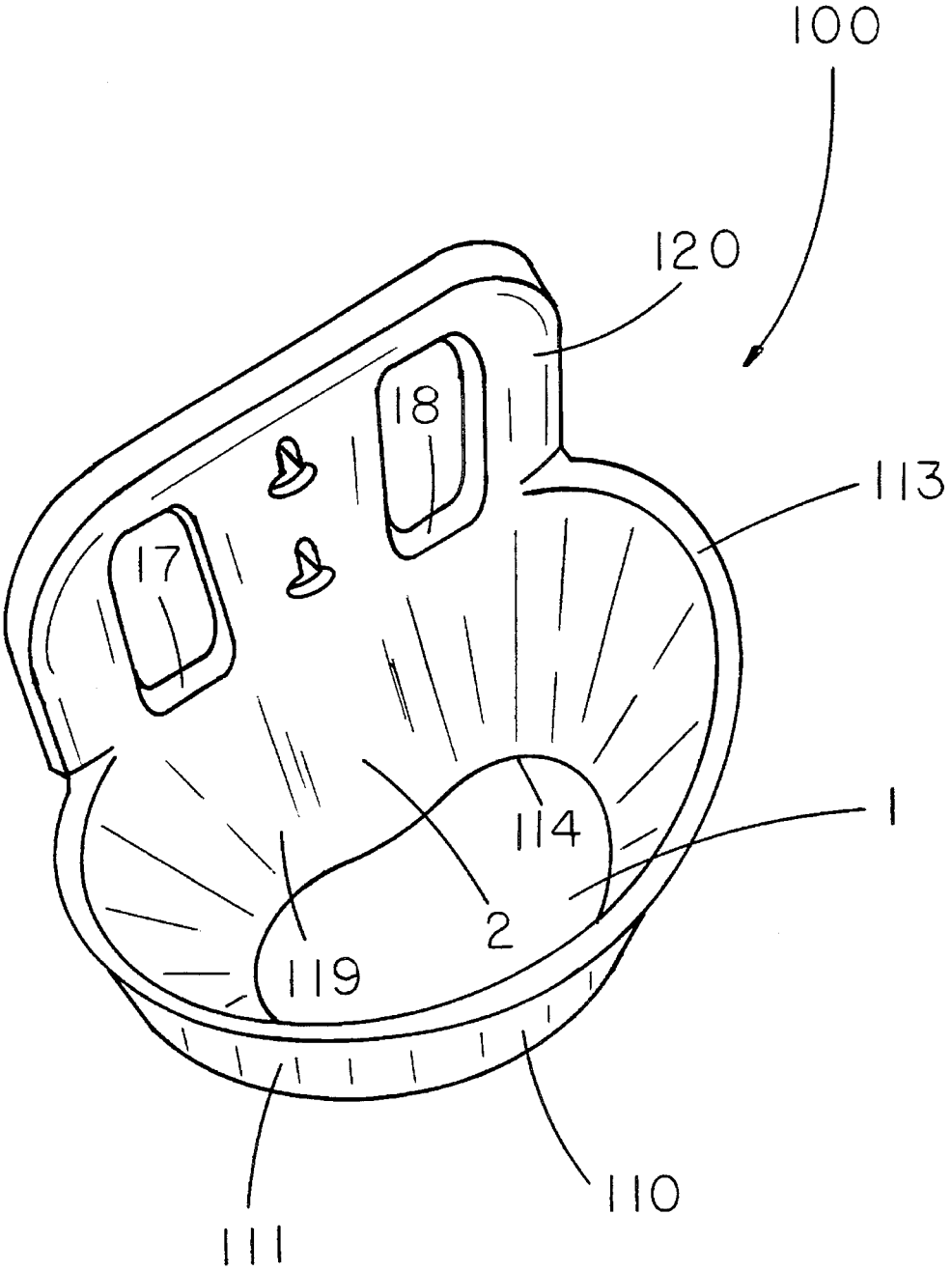
FIG. 8 is a top perspective view of the tool holder depicted in FIG. 3.
Figure 9:
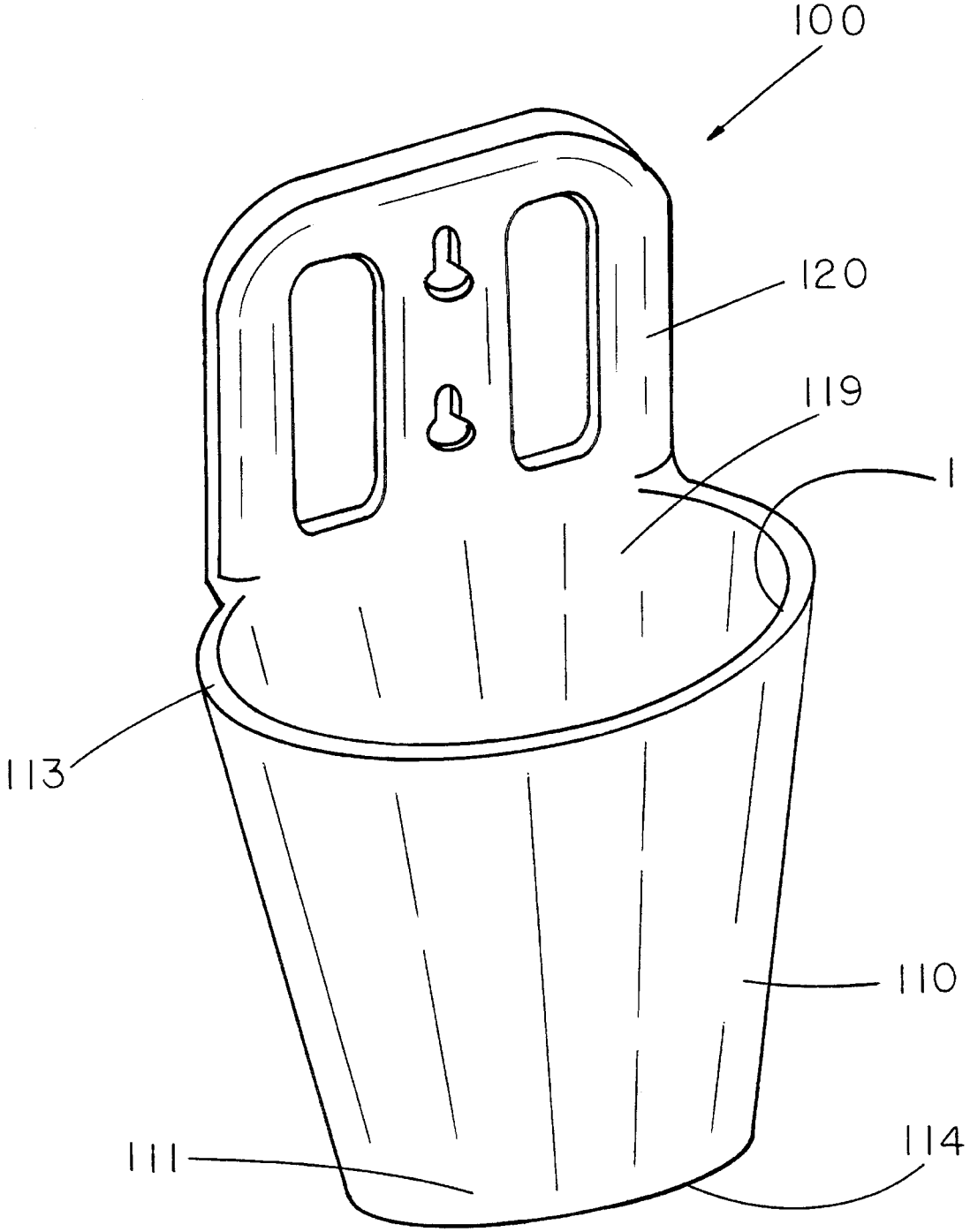
FIG. 9 is a front perspective view of the tool holder depicted in FIG. 3.

A pair of substantially rectangular slots 124*a* and 124*b* are formed in the flat wall 121 on opposite sides of a divider section 123. The slots 124*a* and 124*b* are approximately two and one half inches long and 0.75 inch wide, and have substantially perpendicular sidewalls 17 and 18, respectively, as seen in FIG. 8. The elongated slots 124*a* and 124*b*, along with the divider section 123 cooperate to provide a means for securing the tool holder 100 to a belt 94 (FIG. 4) worn about a person's waist (not shown).

A second embodiment (FIG. 4) of the present tool holder 200 has a transverse opening 227 that extends between the parallel slots 224*a* and 224*b* to define a substantially U shaped opening 227 in panel 221. The transverse opening 227 cooperates with the parallel slots 224*a* and 224*b* to define a downwardly extending finger portion 19 of the panel 221. The result is a means for clipping the tool holder 200 onto the belt 94 without removing the belt from the person's waist. The holster 200 is secured to belt 94 by looping belt 94 around the finger portion 19.

With reference back to FIG. 1, a pair of upwardly narrowing openings 125*a* and 125*b* are formed in the divider section 123, one above the other. Each of the openings 125*a* and 125*b* includes a slot that extends upward from a circular hole. The hole is designed to be larger than the head of a conventional screw, and the slot is designed to be narrower than the head of a conventional screw but wider than the shaft of a conventional screw. The openings 125*a* and 125*b* cooperate with a pair of conventional screws to provide a means for securing the tool holder 100 to a wall. This mode of operation is shown in FIG. 5 with reference to a third tool holder 300 constructed according to the principles of the present invention. Two screws 95 are threaded partially into a wall 96, such that a portion of each shaft extends between a respective screw head and the outer surface of the wall. The screws 95 are spaced a distance apart from one another equal to the distance between the openings 325*a* and 325*b* (approximately one and one-quarter inches as measured between common features on the two openings). With the heads of the screws 95 spaced slightly more than one-quarter of an inch away from the wall 96, the circular portions of the openings 325*a* and 325*b* are aligned with the screw heads. As the tool holder 300 is pressed against the wall, the screw heads pass through the circular portions of the openings 325*a* and 325*b*. Then, the tool holder 300 is allowed to slide down relative to the wall 96 and the screws 95 until the upper ends of the slot portions of the openings 325*a* and 325*b* engage the shafts of the screws, at which point small portions of the divider section 323 are captured between the screw heads and the wall.

As shown in FIG. 5, the holster portion 310 of the third embodiment 300 supports a hand held drill 90 at an angle relative to the attachment portion 320. This angle of approximately 40 degrees further facilitates removal and replacement of the hand held drill under certain circumstances, and this angle may vary from one embodiment to another according to parameters such as the particular tool for which the tool holder is designed and the particular storage location for the tool holder. In the third embodiment 300, the outwardly extending tab 315 conveniently supports a drill chuck 97 for use in connection with the drill 90.

Figure 6:
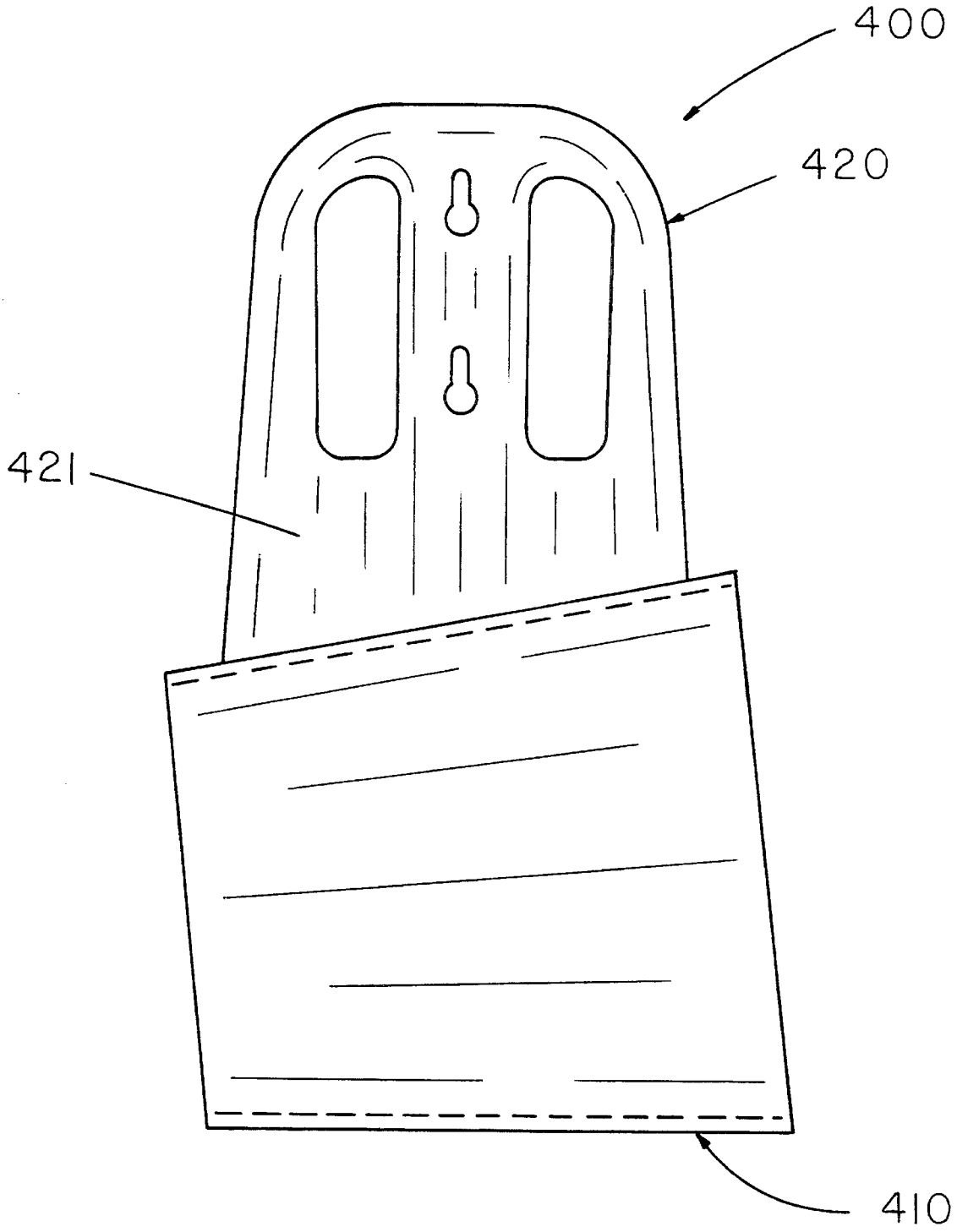
FIG. 6 is a front view of a fourth tool holder constructed according to the principles of the present invention.

A more extreme angle of inclination is shown in FIG. 6, where the holster portion 410 of a fourth tool holder 400 is almost perpendicular to the attachment portion 420. Among other things, the extreme angle of inclination allows the tool holder 400 to be mounted higher on a wall without sacrificing access to the tool being held.

In a preferred embodiment, the tool holder is "safety" yellow and is made of high density polyethylene. The yellow color makes the tool holder 100 readily visible, and the rigidity makes the tool holder 100 easy to use. Although yellow is the color of the preferred embodiment, making the tool holder 100 in a variety of highly visible colors allows a person to color code his or her tools, so that they are more readily identified at any distance within a typical workshop.

Since the tool holder 100 is easily secured to and removed from a wall, as well as a person's belt, there is no reason to remove a tool from its particular holder other than when the particular tool is in use. In this regard, the present invention provides a method for maintaining an organized assortment of tools. When you need a drill you look to a particular location on a particular wall, and/or you look for yellow, when you see red you immediately think "soldering gun", etc. . . . Although the preferred embodiment tool holder 100 is designed to be relatively universal in its application, each of a set of holsters may be customized somewhat to better accommodate a particular tool. Those skilled in the art should also recognize that the term "tool holder" is not meant to include tool cases, packaging, or the like. As used with reference to the present invention, the term "tool holder" is meant to imply that a tool is held in such a manner that it may be readily found, grasped, and removed.

The present invention has been described with reference to particular embodiments, having specific dimensions and applications. However, those skilled in the art will recognize additional embodiments, having different dimensions and/or applications, which nonetheless fall within the scope of the present invention. Accordingly, the present invention is limited only by the following claims.

I claim:

1. I claim a tool holder of a type that holds a hand held tool so as to be readily accessible, comprising:

(a) a slightly resilient holster having an upper end and a lower end, the upper end of the tool holster defining a first surface area and the lower end of the tool holster defining a second surface area, the second surface area being at least eighty percent as large as the first surface area;

(b) an epitrochoidal cavity, the epitrochoidal cavity residing between the upper end and the lower end of the holster;

(c) a belt mounting means for securing the holster to a belt of a type worn about a person's waist, the belt mounting means including a rigid panel extending outwardly from the epitrochoidal cavity, the rigid panel being perforated by a pair of laterally spaced slots of sufficient size to receive a belt;

(d) a wall mounting means for securing the holster to a wall surface, the wall mounting means being formed by a perforation of the rigid panel, the perforation including at least one hole formed through a section of the rigid panel disposed between the laterally spaced slots; and (e) a chuck key retaining means formed as an integral part of the holster proximate the upper end of the holster.

2. The tool holder of claim 1, wherein the holster is formed substantially of high density polyethylene of a substantially uniform color.

3. The tool holder of claim 2, wherein the belt mounting means includes a substantially U shaped opening formed within the rigid panel so as to define a downwardly extending finger portion of the rigid panel, thereby providing a means for selectively clipping the tool holder to the belt.

4. I claim A universal tool holder, comprising:

(a) an epitrochoidal cavity, the epitrochoidal cavity being defined by a convex wall and an opposed concave wall, the epitrochoidal cavity having an upper opening and a lower opening, the upper opening having a first surface area, the lower opening having a second surface area, the second surface area being at least eighty percent of the first surface area, the epitrochoidal cavity forming a biasing crease along a longitudinal axis of the convex wall, the biasing crease urging a tool residing within the cavity toward the concave wall; and (b) a rigid mounting panel, the rigid mounting panel being integrally formed with and joined to the epitrochoidal cavity adjacent to the upper opening, the mounting panel being tilted with respect to the convex wall of the cavity by an inclination of approximately five degrees.

* * * * *